US006629836B2

(12) United States Patent
Campbell

(10) Patent No.: US 6,629,836 B2
(45) Date of Patent: Oct. 7, 2003

(54) CAP FOR A JAR CONTAINING A CANDLE AND THE JAR CONTAINING THE CANDLE AND THE CAP THEREFORE

(76) Inventor: Bruce Campbell, 620 Meday Ave., Mattituck, NY (US) 11952

( * ) Notice: Subject to any disclaimer, the term of this patent is extended or adjusted under 35 U.S.C. 154(b) by 0 days.

(21) Appl. No.: 10/037,331

(22) Filed: Oct. 25, 2001

(65) Prior Publication Data

US 2003/0082494 A1 May 1, 2003

(51) Int. Cl.[7] ..... F23N 5/00
(52) U.S. Cl. ..... 431/33; 431/298
(58) Field of Search ..... 431/33, 34, 320, 431/321, 322, 323, 324, 298; 126/43, 44, 45, 46; 215/316, 320; 220/254.1, 254.7

(56) References Cited

U.S. PATENT DOCUMENTS 3,307,602 A * 3/1967 Boster ..... 220/254.7
4,832,225 A * 5/1989 Benjamin ..... 220/254.1
4,850,858 A * 7/1989 Blankenship et al. ..... 431/320
5,193,521 A * 3/1993 Levinson et al. ..... 126/45
5,567,146 A * 10/1996 Blankenship et al. ..... 431/320
5,842,593 A * 12/1998 von Holdt ..... 220/212.5
5,879,151 A * 3/1999 Schultz et al. ..... 431/291
5,975,381 A * 11/1999 Revenu ..... 222/563
6,010,332 A * 1/2000 Lee et al. ..... 431/320
6,035,847 A * 3/2000 Paul ..... 126/43

* cited by examiner

*Primary Examiner*—Alfred Basichas

(57) ABSTRACT

A cap for a jar containing a candle. The cap includes a lid and a snuffer plug. The lid is non-metallic and has a single exhaust throughbore that extends axially and centrally therethrough. The snuffer plug is dimensioned to fit securely into the single exhaust throughbore in the lid. The lid is preferably made of a heat insulating material, such as glass, and is dimensioned to fit snugly onto/into the open top of the jar. The single exhaust throughbore in the lid is preferably approximately 1.5 inches in diameter. The lid may be fluted and either transparent or translucent to provide decorative light diffusion.

20 Claims, 2 Drawing Sheets

CAP FOR A JAR CONTAINING A CANDLE AND THE JAR CONTAINING THE CANDLE AND THE CAP THEREFORE

BACKGROUND OF THE INVENTION

1. Field of the Invention

The present invention relates to a cap for a jar. More particularly, the present invention relates to a cap for a jar containing a candle and the jar containing the candle and the cap therefor.

2. Description of the Prior Art

Candles are popular aesthetic accessories for many occasions. A popular type of candle is the "jar candle" which is a wax candle housed in a glass jar approximately three to four inches in diameter.

Jar candles have several advantages. The chief advantage of a jar candle is that the wax is contained so that it will not drip onto the surface of furniture when the candle is burning. Because the wax is contained, however, there is a hazard that a substantial volume of hot wax can spill out of the jar if it is tipped over. In addition, the accumulation of molten wax around the burning wick of the candle causes the flame to deliver a significant amount of soot into the air and/or the interior of the jar. Generally, jar candles do not provide an efficient combustion system.

In a serendipitous experiment, one inventor created and improved jar candle by providing metal cap with many holes to place on top of the jar. The cap was designed to project images onto the ceiling from the light of the candle, but eventually proved to enhance combustion in the jar candle.

The multi-ported jar candle caps, however, have several disadvantages. The metal cap gets very hot, and as a result thereof, possess a burning hazard if accidently touched. This is particularly problematic when trying to extinguish the candle. The cap does not provide tip-over security. If the jar candle is tipped over, hot wax will flow out of one or more of the many holes in the cap. Due to the relatively small exhaust port at the center of the cap, it may restrict air flow, trap too much heat, overheat the molten wax, diminish candle scent by flashing off and breaking down sensitive scent molecules, and raise the temperature of the jar higher than it would be otherwise. The cap does not contain any exhaust fumes when the candle is extinguished and releases the concentrated soot particles into the atmosphere. Due to slower air and exhaust movement, it is more susceptible to the Venturi effect created by small breezes.

In any event, numerous innovations for candle holding related devices have been provided in the prior art that will be described infra. Even though these innovations may be suitable for the specific individual purposes to which they address, however, they differ from the present invention.

FOR EXAMPLE, U.S. Pat. No. 3,781,164 to McCaffery teaches an anti-spill container for candles of the type wholly contained within the container including a tubular body having a closed end and an open end. An inwardly directed tubular flange extends from the open end in a direction axially into the tubular container to define an annular recess which opens toward the closed end of the tubular body for collection of melted material from a lighted candle when the container is turned on its side.

ANOTHER EXAMPLE, U.S. Pat. No. 5,197,454 to Lee teaches a candle holder with devices for allowing fragrance to be volatilized and for warming a cup. The candle holder has a base with a holder attached thereto and a positioning seat with a socket formed therein. A plurality of vents are formed in the base which introduces fresh air into a wind shield which is placed around the seat. A top of the wind shield is placed a bowl on which fragrance is deposited. On top of the bowl is an upper supporting device on which a cup is placed.

STILL ANOTHER EXAMPLE, U.S. Pat. No. 6,231,336 to Chen teaches a shade structure for a candle, and in particular, the shade structure comprising a container body for containing a candle, a shade body with a center air hole and detachably mounted onto the circumferential edge of the container body, and a covering plate having a center hole aligned with the center air hole of the shade body. The shade body is provided with a plurality of auxiliary openings which are corresponding to a plurality of through holes provided on the upper edge of the covering plate. The covering plate can be rotated with respect to the shade body such that the through holes align with the auxiliary openings and this will control convection of air within the container body. The temperature within the container body is thus regulated by adjusting the covering plate with respect to the shade body.

YET ANOTHER EXAMPLE, U.S. Pat. No. 6,261,088 to Butler teaches a flame cover device for use with mechanical candle holders, especially for use with candle holders in which the candle is spring-driven to the top of a tube as the candle is consumed. The apparatus may be removably disposed upon the top portion of the tube of the mechanical candle holder, where it remains motionless while the candle is burned by combustion, yet provides protection from and to the burning flame. A base of the device is engaged with the tube of the mechanical candle holder, with vents in the base providing adequate ventilation to the flame. A transparent shell extends up from the base to provide flame protection. A ring damper is provided for covering the vents in the base to assist the flame in windy conditions. It is apparent that numerous innovations for candle holding related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a cap for a jar containing a candle that avoids the disadvantages of the prior art.

ANOTHER OBJECT of the present invention is to provide a cap for a jar containing a candle that is simple to use.

BRLEFLY STATED, STILL ANOTHER OBJECT of the present invention is to provide a cap for a jar containing a candle. The cap includes a lid and a snuffer plug. The lid is non-metallic and has a single exhaust throughbore that extends axially and centrally therethrough. The snuffer plug is dimensioned to fit securely into the single exhaust throughbore in the lid. The lid is preferably made of a heat insulating material, such as glass, and is dimensioned to fit snugly onto/into the open top of the jar. The single exhaust throughbore in the lid is preferably approximately 1.5 inches in diameter. The lid may be fluted and either transparent or translucent to provide decorative light diffusion.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
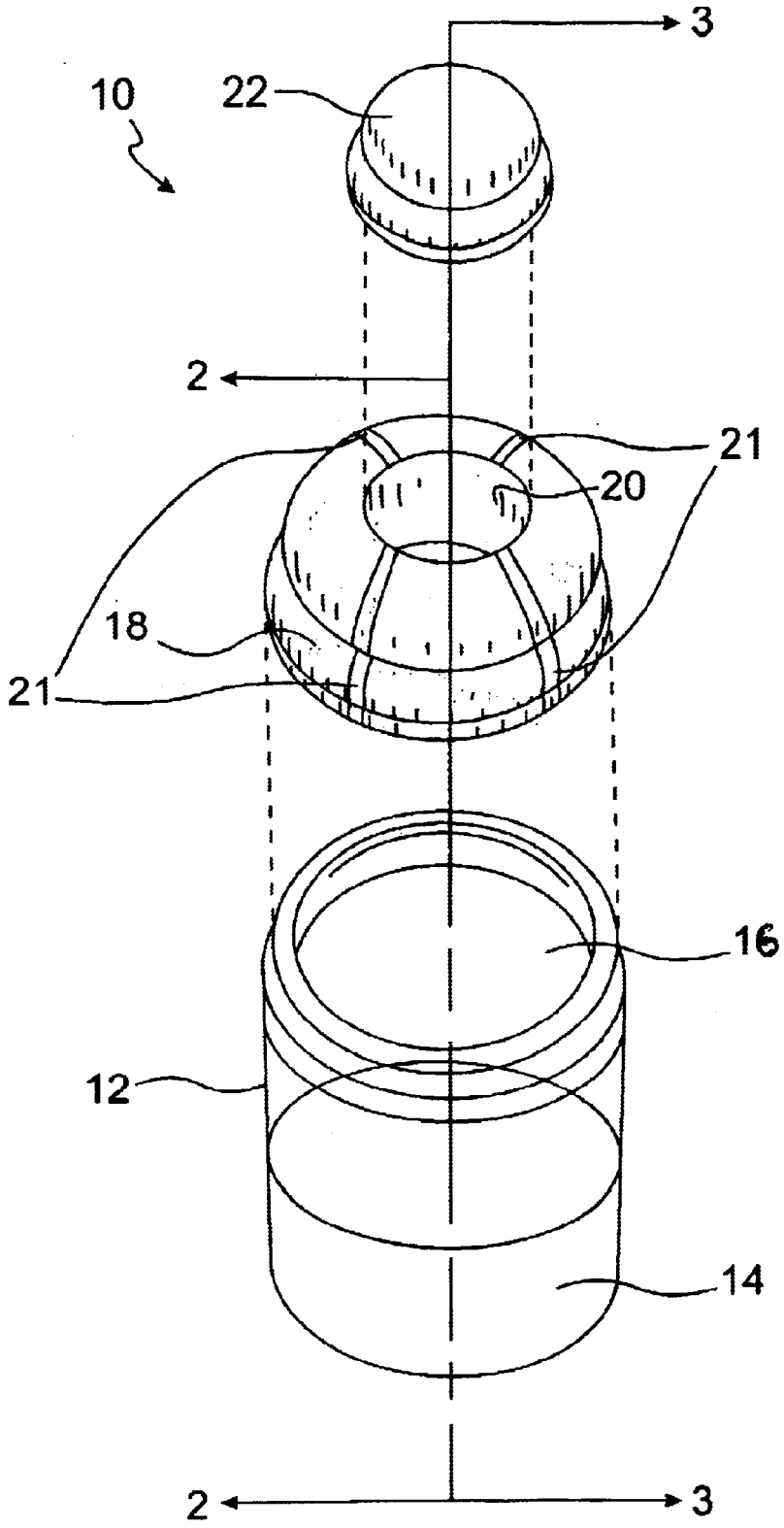
FIG. 1 is an exploded diagrammatic perspective view of the cap of the present invention cooperating with a jar containing a candle.

10 cap of present invention for jar 12 containing candle 14
12 jar containing candle 14
14 candle contained in jar 14
16 top of jar 12
18 lid for being dimensioned to fit snugly onto/into top 16 of jar, for providing spill protection if jar 12 is tipped over, for minimizing turbulence, and for having airborne soot deposits from candle 14 deposited thereon when jar 12 cools
20 single exhaust throughbore in lid 18 for creating chimney effect for flame 24 of candle
22 snuffer plug for easily, safely, and effectively extinguishing candle 14, for suffocating flame 24 of candle 14, for containing and trapping smoke 26 and all emissions 28 which results from smoldering wick 30 of the candle 14 when oxygen is removed from combustion, and for having airborne soot deposits 32 from candle 14 deposited thereon when jar 12 cools
24 flame of candle 14
26 smoke from smoldering wick 30 of candle 14
28 emissions from smoldering wick 30 of candle 14
30 smoldering wick of candle 14
32 airborne soot deposits from candle 14

DETAILED DESCRIPTION OF THE PREFERRED EMBODIMENT

Referring now to the figures, in which like numerals indicate like parts, and particularly to FIG. 1, which is an exploded diagrammatic perspective view of the cap of the present invention cooperating with a jar containing a candle, the cap of the present invention is shown generally at 10 for a jar 12 containing a candle 14. The jar 12 has a top 16 that is open. The cap 10 comprises a lid 18. The lid 18 is dimensioned to fit snugly onto/into the top 16 of the jar 12, and as a result thereof, closes the top 16 of the jar 12. The lid 18 provides spill protection if the jar 12 is tipped over, and as a result thereof, provides tip over security.

The lid 18 has a single exhaust throughbore 20 that extends axially and centrally therethrough. The throughbore 20 in the lid 18 creates a chimney effect for the flame of the candle 14 which does not restrict air and exhaust flow from the candle 14 and keeps air and exhaust flow from the candle 14 fairly consistent and minimizes turbulence so as to produce a stable flame. The stable flame of the candle 14 allows scent thrown from the candle 14 to become steady and consistent, and as a result thereof, does not diminish candle scent. The stable flame of the candle 14 allows use of smaller and less volatile wicks of the candle 14 because heat is trapped while exhaust gases are expunged. The stable flame of the candle 14 provides a more uniform formation and temperature of the pool of molten wax of the candle 14 due to a lower temperature difference between internal candle atmosphere and the pool of molten wax of the candle 14, and as a result thereof, does not cause the molten wax to overheat.

The lid 18 is non-metallic, preferably made of a heat insulating material, such as glass so as not to get very hot, is either transparent or translucent, and has fluting 21 to provide decorative light diffusion produced by the candle 14.

The single exhaust throughbore 20 in the lid 18 is preferably in a range of about 1 to 2 inches in diameter, but most desirably is approximately 1.5 inches in diameter to minimize flame flicker and assure proper and enhanced combustion of the candle 14.

The cap 10 further comprises a snuffer plug 22. The snuffer plug 22 easily, safely, and effectively extinguishes the candle 14 by virtue of eliminating a risk of burns and by minimizing soot from the candle 14 from entering into the atmosphere, and as a result thereof, reduces pollution. The snuffer plug 22 is dimensioned to fit securely into the single exhaust throughbore 20 in the lid 18, and as a result thereof, selectively closes the single exhaust throughbore 20 in the lid 18.

Figure 2:
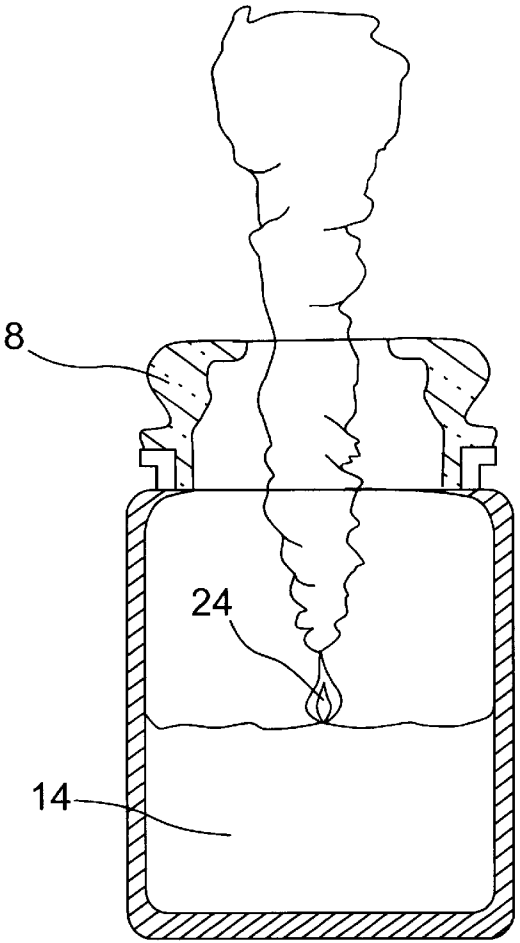
FIG. 2 is a diagrammatic cross sectional view taken on LINE 2—2 in FIG. 1.

As shown in FIG. 2, which is a diagrammatic cross sectional view taken on LINE 2—2 in FIG. 1, the lid 18 also minimizes turbulence which prevents the flame 24 of the candle 14 from flickering by virtue of the lid 18 protecting the candle 14, when the candle 14 is burning, from convection currents and breezes that normally disrupt the candle 14 in the jar 12. Even though modest breezes may be present, the flame 24 of the candle 14 remains stable because the modest breezes cannot overcome the velocity of the chimney effect of the flame 24 of the candle 14, and as a result thereof, there is less susceptibility to the Venturi effect created by small breezes.

Figure 3:
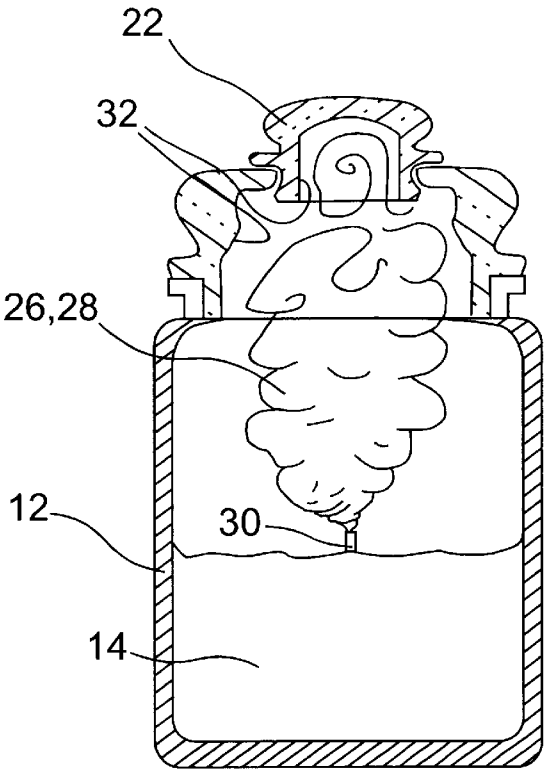
FIG. 3 is a diagrammatic cross sectional view taken on LINE 3—3 in FIG. 1.

As shown in FIG. 3, which is a diagrammatic cross sectional view taken on LINE 3—3 in FIG. 1, the snuffer plug 22 suffocates the flame 24 of the candle 14 with oxygen deprivation. The snuffer plug 22 contains and traps smoke 26 and all emissions 28 which result from the smoldering wick 30 of the candle 14 when oxygen is removed from combustion.

The lid 18 and the snuffer plug 22 both have airborne soot deposits 32 from the candle 14 deposited thereon when the jar 12 cools, and as a result thereof, the airborne soot deposits 32 from the candle 14 are allowed to be safely wiped off the lid 18 and the snuffer plug 22 as a solid, and as a result thereof, pollution is reduced.

It will be understood that each of the elements described above, or two or more together, may also find a useful application in other types of constructions differing from the types described above.

While the invention has been illustrated and described as embodied in a cap for a jar containing a candle, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A cap for a jar containing a candle, wherein the jar has a top that is open, said cap comprising:

a) a lid; and b) a snuffer plug;

wherein said lid is for being dimensioned to fit snugly onto/into the top of the jar, and as a result thereof, closes the top of the jar;

wherein said lid is for providing spill protection if the jar is tipped over, and as a result thereof, provides tip over security;

wherein said lid is for having airborne soot deposits from the candle deposited thereon when the jar cools, and as a result thereof, the airborne soot deposits from the candle are allowed to be safely wiped off said lid as a solid, and as a result thereof, pollution is reduced;

wherein said lid has a single exhaust throughbore;

wherein said single exhaust throughbore in said lid is for creating a chimney effect for the flame of the candle which does not restrict air and exhaust flow from the candle and keeps air and exhaust flow from the candle fairly consistent and minimizes turbulence so as to produce a stable flame which allows scent thrown from the candle to become steady and consistent, and as a result thereof, does not diminish candle scent, and allows use of smaller and less volatile wicks of the candle because heat is trapped while exhaust gases are expunged, and provides a more uniform formation and temperature of the pool of molten wax of the candle due to a lower temperature difference between internal candle atmosphere and the pool of molten wax of the candle, and as a result thereof, does not cause the molten wax to overheat;

wherein said lid is for minimizing turbulence which prevents the flame of the candle from flickering by virtue of said lid protecting the candle, when the candle is burning, from convection currents and breezes that normally disrupt the candle in the jar, and even though modest breezes are present, the flame of the candle remains stable because the modest breezes cannot overcome the velocity of the chimney effect for the flame of the candle, and as a result thereof, there is less susceptibility to the Venturi effect created by small breezes;

wherein said snuffer plug is dimensioned to fit securely into said single exhaust throughbore in said lid, and as a result thereof, selectively closes said single exhaust throughbore in said lid;

wherein said snuffer plug is for easily, safely, and effectively extinguishing the candle by virtue of eliminating a risk of burns and by minimizing soot from the candle from entering into the atmosphere, and as a result thereof, reduces pollution;

wherein said snuffer plug is for suffocating the flame of the candle with oxygen deprivation;

wherein said snuffer plug is for containing and trapping smoke and all emissions which result from the smoldering wick of the candle when oxygen is removed from combustion; and wherein said snuffer plug is for having airborne soot deposits from the candle deposited thereon when the jar cools, and as a result thereof, the airborne soot deposits from the candle are allowed to be safely wiped off said snuffer plug as a solid, and as a result thereof, pollution is reduced.

2. The cap as defined in claim 1, wherein said single exhaust throughbore extends axially through said lid; and wherein said single exhaust throughbore extends centrally through said lid.

3. The cap as defined in claim 1, wherein said lid is non-metallic.

4. The cap as defined in claim 1, wherein said lid is made of a heat insulating material so as to not get very hot.

5. The cap as defined in claim 4, wherein said heat insulating material of said lid is glass.

6. The cap as defined in claim 1, wherein said cap is transparent.

7. The cap as defined in claim 1, wherein said cap is translucent.

8. The cap as defined in claim 1, wherein said cap is fluted for providing decorative light diffusion produced by the candle.

9. The cap as defined in claim 1, wherein said single exhaust throughbore in said lid is in a range of about 1 to 2 inches in diameter.

10. The cap as defined in claim 9, wherein said single exhaust throughbore in said lid is approximately 1.5 inches in diameter for minimizing flame flicker and assure proper and enhanced combustion of the candle.

11. Ajar candle, comprising:

a) a jar b) a candle c) a lid; and d) a snuffer plug;

wherein said jar has a top;

wherein said top of said jar is open;

wherein said candle is contained in said jar;

wherein said lid is dimensioned to fit snugly onto/into said top of said jar, and as a result thereof, closes said top of said jar;

wherein said lid provides spill protection if said jar is tipped over, and as a result thereof, provides tip over security;

wherein said lid is for having airborne soot deposits from said candle deposited thereon when said jar cools, and as a result thereof, the airborne soot deposits from said candle are allowed to be safely wiped off said lid as a solid, and as a result thereof, pollution is reduced;

wherein said lid has a single exhaust throughbore;

wherein said single exhaust throughbore in said lid is for creating a chimney effect for the flame of said candle which does not restrict air and exhaust flow from said candle and keeps air and exhaust flow from said candle fairly consistent and minimizes turbulence so as to produce a stable flame which allows scent thrown from said candle to become steady and consistent, and as a result thereof, does not diminish candle scent, and allows use of smaller and less volatile wicks of said candle because heat is trapped while exhaust gases are expunged, and provides a more uniform formation and temperature of the pool of molten wax of said candle due to a lower temperature difference between internal candle atmosphere and the pool of molten wax of said candle, and as a result thereof, does not cause the molten wax to overheat;

wherein said lid minimizes turbulence which prevents the flame of said candle from flickering by virtue of said lid protecting said candle, when said candle is burning, from convection currents and breezes that normally disrupt said candle in said jar, and even though modest breezes are present, the flame of said candle remains stable because the modest breezes cannot overcome the velocity of the chimney effect of the flame of said candle, and as a result thereof there is less susceptibility to the Venturi effect created by small breezes;

wherein said snuffer plug is dimensioned to fit securely into said single exhaust throughbore in said lid, and as a result thereof, selectively closes said single exhaust throughbore in said lid;

wherein said snuffer plug easily, safely, and effectively extinguishes said candle by virtue of eliminating a risk of burns and by minimizing soot from said candle from entering into the atmosphere, and as a result thereof, reduces pollution;

wherein said snuffer plug suffocates the flame of said candle with oxygen deprivation, wherein said snuffer plug is for containing and trapping smoke and all emissions which result from the smoldering wick of said candle when oxygen is removed from combustion; and wherein said snuffer plug is for having airborne soot deposits from said candle deposited thereon when said jar cools, and as a result thereof, the airborne soot deposits from said candle are allowed to be safely wiped off said snuffer plug as a solid, and as a result thereof, pollution is reduced.

12. The cap as defined in claim 11, wherein said single exhaust throughbore extends axially through said lid; and wherein said single exhaust throughbore extends centrally through said lid.

13. The cap as defined in claim 11, wherein said lid is non-metallic.

14. The cap as defined in claim 11, wherein said lid is made of a heat insulating material so as to not get very hot.

15. The cap as defined in claim 14, wherein said heat insulating material of said lid is glass.

16. The cap as defined in claim 11, wherein said cap is transparent.

17. The cap as defined in claim 11, wherein said cap is translucent.

18. The cap as defined in claim 11, wherein said cap is fluted for providing decorative light diffusion produced by the candle.

19. The cap as defined in claim 11, wherein said single exhaust throughbore in said lid is in a range of about 1 to 2 inches in diameter.

20. The cap as defined in claim 19, wherein said single exhaust throughbore in said lid is approximately 1.5 inches in diameter for minimizing flame flicker and assure proper and enhanced combustion of said candle.

* * * * *